United States Patent [19]

Yamashita

[11] 4,426,030

[45] Jan. 17, 1984

[54] VARIABLE SPEED TAPE FEEDING APPARATUS

[76] Inventor: Kyoichi Yamashita, 2361 Nippa-cho, Kohoku-ku, Yokohama-shi, Kanagawa 223, Japan

[21] Appl. No.: 292,344

[22] Filed: Aug. 12, 1981

[30] Foreign Application Priority Data

Aug. 13, 1980 [JP] Japan ..... 55-110286

[51] Int. Cl.[3] ..... B65H 23/18; B65H 17/22

[52] U.S. Cl. ..... 226/181; 226/29

[58] Field of Search ..... 226/181, 27, 28, 29, 226/30, 31, 37, 40

[56] References Cited

U.S. PATENT DOCUMENTS

| | | | |
|---|---|---|---|
| 2,119,670 | 6/1938 | Fitzgerald | 226/29 |
| 2,249,190 | 7/1941 | Thompson | 226/31 |
| 2,576,529 | 11/1951 | McKenney | 226/31 |
| 2,768,827 | 10/1956 | Noble | 226/28 X |
| 3,028,064 | 4/1962 | Thyrlings | 226/181 X |
| 3,949,949 | 4/1976 | Thompson | 226/30 |
| 4,129,238 | 12/1978 | Herd | 226/29 |

*Primary Examiner*—Stuart S. Levy
*Assistant Examiner*—Lloyd D. Doigan
*Attorney, Agent, or Firm*—Armstrong, Nikaido, Marmelstein & Kubovcik

[57] ABSTRACT

An apparatus for feeding at a high speed a tape having a series of the same patterns and check marks printed thereon. The tape is to be divided into sections each bearing one printed pattern. The feeding apparatus comprises a pair of first and second cylindrical drums rotatable in tangential contact so as to pull the tape out of its roll by frictionally driving the tape therebetween. The first drum is mounted for free rotation on a first drive shaft and has a circumference slightly longer than the predetermined design length of one section cut from the tape. The second drum is mounted for free rotation on a second drive shaft and has a circumference slightly shorter than the predetermined length of one section. An electromagnetic clutch is provided between the first drum and the first drive shaft while a unidirectional clutch is provided between the second drum and the second drive shaft. The electromagnetic clutch is brought into and out of transmission engagement under the control of photoelectric means for detecting two successive check marks on the tape. The unidirectional clutch normally transmits the driving force from the second drive shaft to the second drum, but allows the second drum to be rotated with the first drum in frictional contact with the second drum and rotating at a higher circumferential speed. In addition, an electromagnetic brake is provided between the second drum and the second drive shaft and is operable to keep the second drum and the second drive shaft in a relative restrained relationship at the same time as the electromagnetic clutch is de-energized.

8 Claims, 8 Drawing Figures

FIG. 7
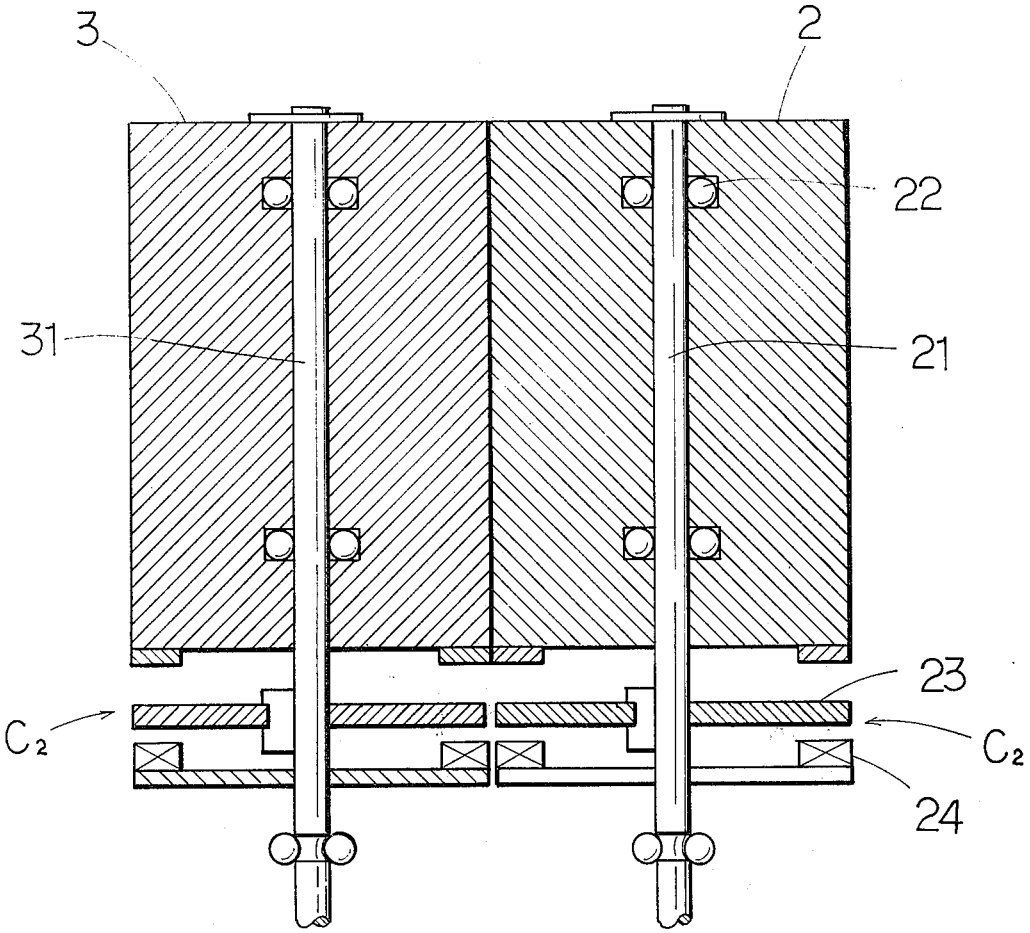
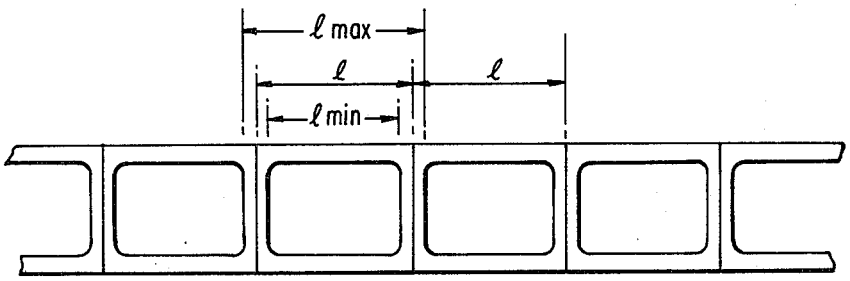
FIG. 8

VARIABLE SPEED TAPE FEEDING APPARATUS

BACKGROUND OF THE INVENTION

This invention relates to a tape feeding apparatus, and more particularly, to an apparatus for feeding a tape bearing repeating patterns printed thereon to a subsequent working station, for example, a cutting machine operating at a constant rate.

Conventional well-known tape feeding apparatus generally feed a tape from its roll at a constant speed for the purpose of printing or cutting. Such feeding apparatus generally use a drum adapted to rotate at a constant speed to pull the tape.

Generally, a tape is fed at a constant speed to a cutting machine operating at a constant rate where the tape is cut into sections of an equal length. However, a problem arises when a tape has a series of repeating patterns printed thereon before it is fed to a cutting machine operating at a constant rate where it is cut into sections each bearing one printed pattern. (Pattern-bearing sections may be used as labels, for example.) In such a case, however, constant feeding of the tape is undesirable because individual pattern-bearing sections of the tape are not exactly equal in length.

The factors causing variations in length of individual pattern-bearing sections are accumulation of slight errors of the position of patterns on the tape during printing, accumulation of expansion and/or shrinkage of the tape itself during printing, elongation of the tape resulting from high speed feeding under increased tension, influence of humidity, conditions under which the roll of tape is stored, slippage of tape and interference by the roll of tape occurring when the tape is taken out, and the like. The difference between two pattern-bearing sections adjoining each other or spaced apart a few sections is, of course, almost negligible or very slight while a considerable difference is found between two sections spaced at a distance. Under these circumstances, if the tape is fed at a constant speed and cut to an equal fixed length, the actual position of cutting will accumulatively deviate from the desired cutting position just intermediate the adjacent patterns.

Therefore, an object of the present invention is to provide a variable speed tape feeding apparatus wherein a tape having a series of repeating patterns printed thereon is fed at a high speed and accurately one by one pattern to a cutting machine operating at a constant rate.

SUMMARY OF THE INVENTION

According to the present invention, there is provided an apparatus for feeding at high speed a tape having a series of successive sections, each having a pattern or label printed on it. Each section is of a predetermined ideal design length "l" when the tape is first produced and bears on its back a black mark, or check mark, the initial separation between any two successive check marks also being equal to the design length "l". The tape is subject to expansion or shrinkage when in use and each section may expand to a maximum length of $l_{max}$ or shrink to a minimum length of $l_{min}$. The tape is feed through a pair of drums, one of which has a diameter of $(l_{max}+d)$ which is slightly longer than $l_{max}$ and the other of which has a diameter of $(l_{max}-d)$ which is slightly smaller than $l_{min}$.

The drums rotate freely with their respective driving shafts. Rotational speed, however, can be controlled by the drums, the smaller drum providing a slower rate, and the larger drum a higher rate, of speed. Each drum has a separately controlled clutch which can restrain the speed of its associated drum so that its drum will rotate at the speed of the other drum. A pair of photoelectric tubes are placed in back of the tape spaced from each other a distance D according to the relation $l<D<l+a$, where l is the distance between any two check marks, and "a" is the length of any check mark. The photoelectric tubes detect the presence of the check marks, the detection of a check mark by the upstream tube serving to releasing a magnetic clutch associated with the larger drum and the detection of a mark by the downstream tube serving to actuate the same clutch. The detectors react to a difference from the original design tape length "l" to change the speed of rotation of the smaller drum through a clutch and brake system so that the tape proceeds at a rate of speed which brings the same number of tape sections past a given point as would have passed the given point if the tape sections were still of the ideal design length "l".

BRIEF DESCRIPTION OF THE DRAWINGS

These and other objects and advantages of the invention may be readily understood by referring to the following description and appended drawings in which:

FIG. 7 is a cross-sectional view similar to FIG. 2, showing another embodiment of paired drums according to the present invention.

FIG. 8 is a schematic illustration of the tape length concepts of the present invention.

DESCRIPTION OF THE PREFERRED EMBODIMENTS

Figure 6:
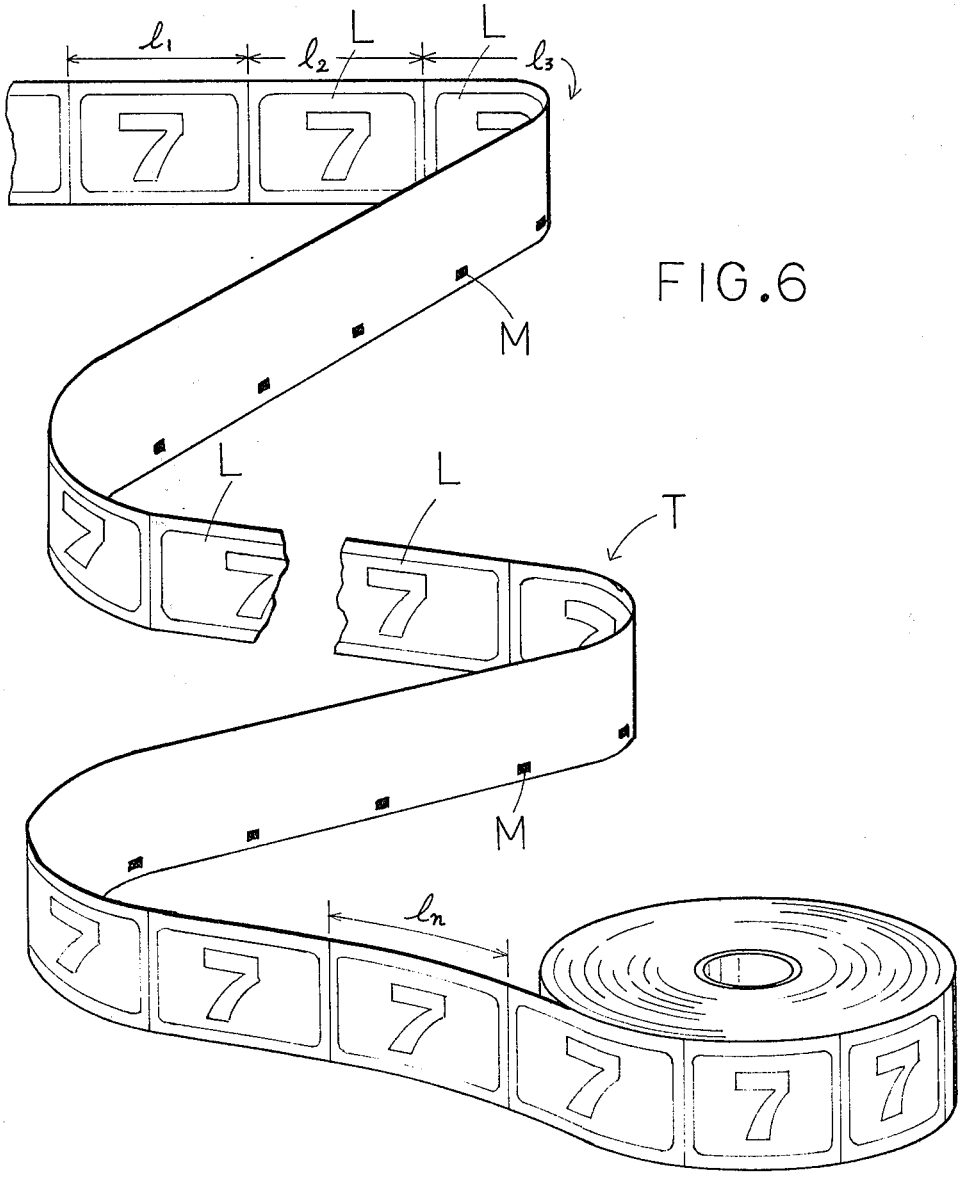
FIG. 6 is a perspective view of a tape having repeating patterns printed thereof.

First referring to FIG. 6, a tape T is illustrated in a serpentine form as having repeating patterns printed thereon. A section bearing one pattern is designated at L. The pattern-bearing sections L may be used as labels after cutting. One pattern-bearing section has a predetermined length l which is the ideal design length of one section available when neither expansion/shrinkage of the tape nor printing error occurs. As described in the preamble, the pattern-bearing sections have varying lengths due to pulling and other factors. Provided that pattern-bearing sections have actual lengths $l_2, l_2, l_3, \ldots, l_n$ from the leading edge in FIG. 6, the difference between two pattern-bearing sections adjoining each other or spaced apart a few sections, that is, the difference between $l_1$ and $l_2$ or $l_3$ is almost negligible, but the difference between two sections spaced apart at a distance, that is, the difference between $l_1$ and $l_n$ is significant.

In addition to the repeating patterns, the tape also has check marks M printed on the back thereof at regular intervals which are initially set to be equal to the predetermined design length l of one pattern-bearing section L. The distance from the leading side of one mark to that of the following mark is equal to the length of a corresponding section and hence, varies as the tape is transported.

FIG. 8 shows some sections of a new tape having the ideal predetermined design length "l" before the tape has experienced expansion or shrinkage. After expansion or shrinkage, each tape section length may be as wide as some maximum length $l_{max}$ or as narrow as some minimum length $l_{min}$.

A. Drum

Figure 1:
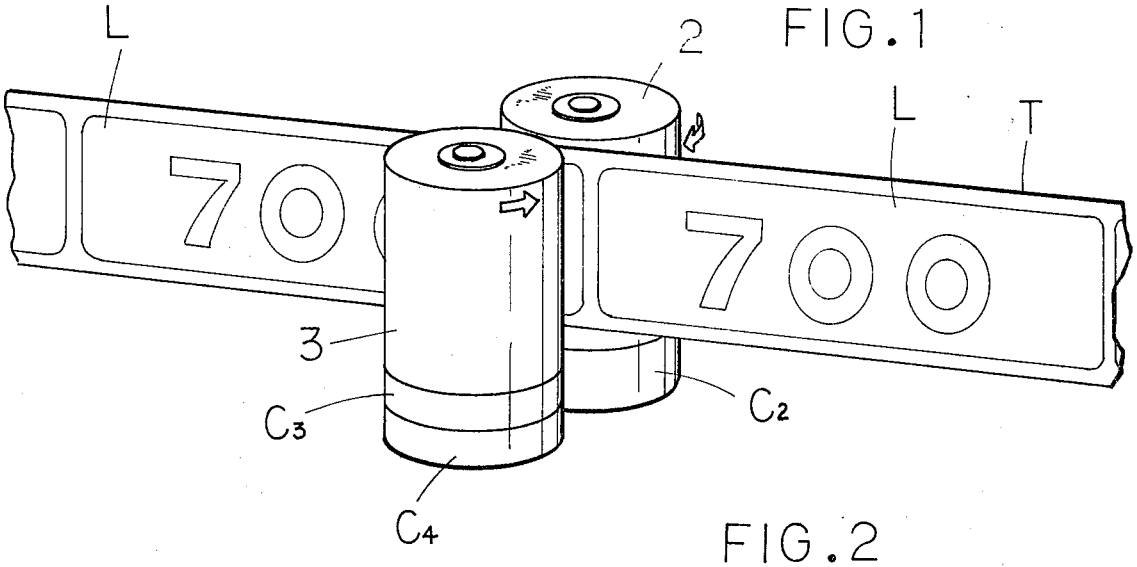
FIG. 1 is a perspective view of a pair of drums between which tape is transported.
Figure 2:
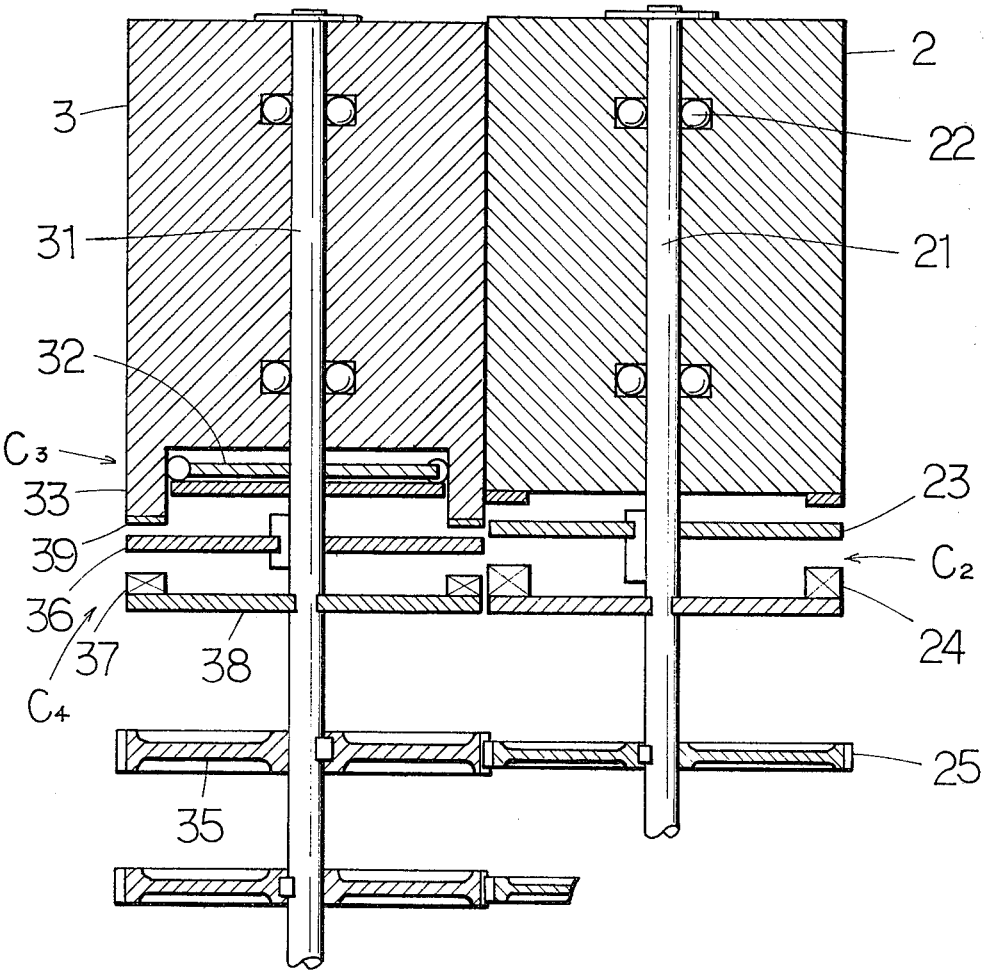
FIG. 2 is a cross-sectional view showing clutch mechanisms associated with a pair of drums.

A feed apparatus is illustrated in FIGS. 1 and 2 as comprising a pair of cylindrical drums 2 and 3 arranged in tangential contact with each other.

The first drum 2 has a circumference ($l_{max}+d$) which is slightly longer than the maximum length $l_{max}$ of one section cut from the tape or a label L and has a circumferential surface portion made of a material having a relatively high coefficient of friction such as rubber. The second drum 3 has a circumference ($l_{min}-d$) which is slightly shorter than the minimum length $l_{min}$ of the label L and has a circumferential surface portion made of a material having a lower coefficient of friction than that for the first drum 2. The first and second drums 2 and 3 are referred to as larger and smaller drums, hereinafter.

It should be noted that since the difference between the maximum length $l_{max}$ and the minimum length $l_{min}$ has been found to be approximately 1 mm or less, this difference is negligible or the maximum length $l_{max}$ and the minimum length $l_{min}$ can be considered equal in the actual design of the drums.

It should also be noted that the accumulation of such slight errors results in a problem as mentioned above when the tape is fed at a high speed.

A gear 25 fixedly secured on the drive shaft 21 meshes with another gear 35 which is fixedly secured on the drive shaft 31 and equal in diameter and number of teeth to the gear 25. Meshing of the gears 25 and 35 ensures that the drive shafts 21 and 31 rotates at the same speed.

B. Electromagnetic clutch

As seen from FIG. 2, the larger drum 2 is mounted for free rotation on a drive shaft 21 which is rotated at a constant speed by means of a drive motor (not shown). Also mounted on the drive shaft 21 is an electromagnetic clutch $C_2$ which serves to selectively transmit the driving force from the shaft 21 to the larger drum 2. The electromagnetic clutch for the transmission of driving force may be any of well-known clutch mechanisms and the typical construction thereof is shown in FIG. 2 by way of illustration, but not for limitation.

In the illustrated embodiment, the larger drum 2 is mounted on the drive shaft 21 via bearings 22 for free rotation. Below the larger drum 2 a clutch disc 23 is mounted for axial motion on the drive shaft 21. However, the disc 23 is restrained with respect to the drive shaft 21 in the direction of rotation. The disc 23 always rotates with the shaft 21.

Placed below the disc 23 is an electromagnetic 24 which is electrically associated with a photoelectric detector to be described later. Energization of the electromagnetic 24 urges the disc 23 upward into engagement with the drum 2. Then, the driving force of the drive shaft 21 is selectively transmitted to the drum 2 through the disc 23 in response to an input to the electromagnet 24.

C. Unidirectional clutch

Figure 3:
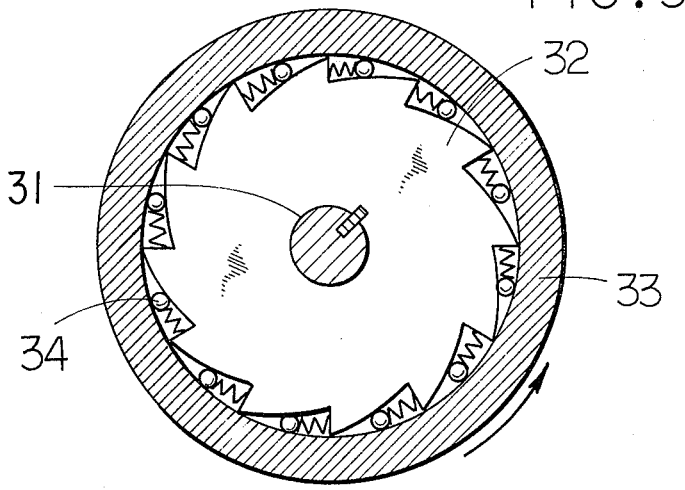
FIG. 3 is a plan cross-sectional view of a unidirectional clutch.

On the other hand, the smaller drum 3 is associated with a unidirectional clutch $C_3$. This clutch may be any of well-known unidirectional clutch mechanisms and the typical construction thereof is shown in FIGS. 2 and 3 by way of illustration, but not for limitation.

In the illustrated embodiment, the smaller drum 3 is mounted for free rotation on a drive shaft 31 via bearings. The smaller drum 3 at the bottom has an annular rim 33 defining a circular recess. A gear 32 fixedly secured to the drive shaft 31 is received in the recess. A plurality of steel balls 34 are placed in spaces defined between the inner wall of the rim 33 and teeth of the gear 32 as best shown in FIG. 3. The rim 33 has a circular inner wall while the teeth of the gear 32 are oriented and slanted in a direction opposite to the direction of rotation shown by an arrow. The balls 34 are preferably biased by individual springs in the opposite direction. When the shaft 31 and the gear 32 rotates in the forward direction, the balls are firmly held between the slanted surface of the gear tooth and the inner wall of the rim 33. In this way, the driving force of the shaft 31 is transmitted to the rim 33 and hence, to the smaller drum 3 via the gear 32 and the balls 34. It should be understood that with this arrangement, the smaller drum 3 is allowed to be forcedly rotated at a higher speed than the drive shaft 31 in the same direction as the latter.

D. Electromagnetic brake

An electromagnetic brake $C_4$ for retaining the drive shaft 31 and the smaller drum 3 in a relatively restrained relationship is associated with the smaller drum 3 for the purpose of preventing the smaller drum 3 from continuing to rotate at a higher speed than the drive shaft 31 for even a very short time due to the presence of the unidirectional clutch $C_3$ when the driving of the paired drums is shifted from the faster mode of feed controlled by the larger drum 2 to the slower mode of feed controlled by the smaller drum 3.

A disc 36 is mounted for axial motion on the drive shaft 31, but is restrained with respect to the drive shaft 31 in the direction of rotation. Placed below the disc 36 is an electromagnetic 37 which is secured to a rotating disc 38 whih is in turn, secured to the drive shaft 31 so as to rotate with it. The lower surface of the annular rim 33 of the smaller drum 3 which faces the disc 36 includes a frictional pad 39.

With this arrangement, energization of the electromagnet 37 causes the disc 36 to engage the frictional pad 39, thereby achieving the relative restraint between the smaller drum 3 and the drive shaft 31. When the disc 36 is disengaged from the frictional pad 39, the drum 3 is free of the drive shaft 31.

E. Tape Mark and Photoelectric Detector

As shown in FIG. 6, the tape T has repeating patterns printed thereon. In addition, black marks M are printed on the back of the tape at regular intervals which are equal to the predetermined length l of one pattern-bearing section L.

The marks M have a width a in the longitudinal direction of the tape.

Figure 4A:
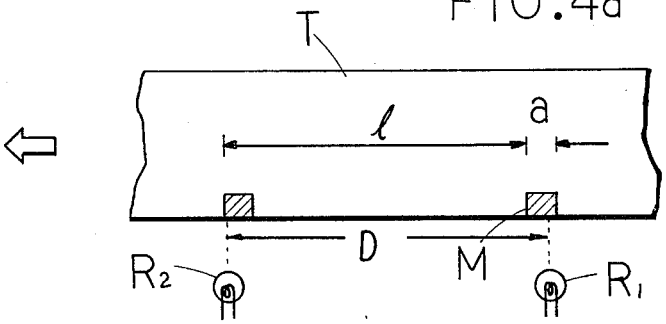
FIGS. 4*a*, 4*b* and 4*c* illustrate the different positions of two successive marks on the tape relative to a pair of photoelectric detectors.

Referring to FIG. 4a, a pair of photoelectric tubes $R_1$ and $R_2$ are arranged parallel to the tape path and spaced apart from each other a distance D which is longer than the predetermined length l between two adjoining marks, but shoter than the sum of this length l and the width a of a mark. This relation is described as follows.

$$l<D<l+a$$

Each photoelectric tube has a light emitting and a light receiving section. This photoelectric tube is turned on to generate a signal when the light emitted from the light emitting section impinges on reflective portions on the tape surface where black marks (light absorbing portions) are absent and the light receiving section receives the thus reflected light. Such photoelectric tubes are commercially available. Any of conventional photoelectric tubes may be used herein as long as they can detect the presence or absence of black marks on the tape.

Figure 5:
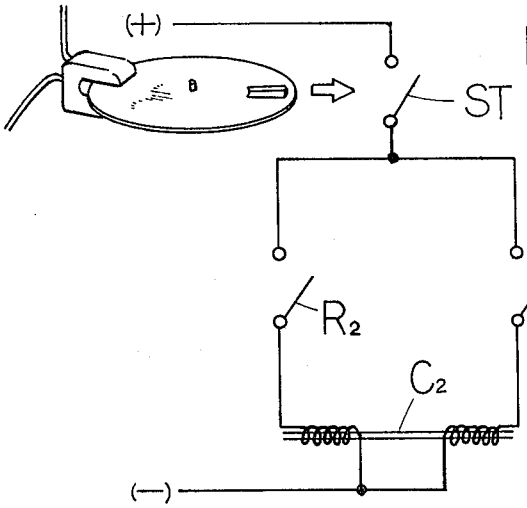
FIG. 5 is a diagram illustrating a signal transmission system.

For the purpose of description, the photoelectric tubes $R_1$ and $R_2$ are referred to as upstream and downstream photoelectric tubes, respectively. An output signal of the upstream photoelectric tube $R_1$ which is generated in the presence of a mark at the position facing the tube serves to release the electromagnetic clutch $C_2$ associated with the larger drum 2 as schematically shown in FIG. 5.

On the other hand, an output signal of the downstream photoelectric tube $R_2$ serves to actuate the electromagnetic clutch $C_2$ associated with the larger drum 2.

The photoelectric tubes $R_1$ and $R_2$ are not always energized, but once per revolution of the drums 2 and 3. To this end, a timing switch ST may be inserted between a power source and the photoelectric tubes as shown in FIG. 5. The timing switch ST may be in the form of another photoelectric detector combined with a rotating disc having a slit formed therein. The disc rotates at the same number of revolutions per minute as the driving shafts 21, 31 of the drum 2, 3. The timing switch ST is closed once per revolution of the drums 2 and 3 and at this instant the photoelectric tubes $R_1$ and $R_2$ are energized.

The operation of the above-mentioned apparatus is described below.

Tape setting

The leading edge of the tape T is manually unwound from its roll, trained around tension and guide rollers (not shown) and then between the drums 2 and 3, and led to a subsequent working station (not shown), for example, a cutter or secondary printing machine. At this point, the photoelectric detectors $R_1$ and $R_2$ and the timing switch ST (the position of the slit) are adjusted so that both the detectors may be aligned with two successive marks M and actuated only at the time of alignment as shown in FIG. 4*a*.

In this connection, the spacing between the upstream and downstream detectors $R_1$ and $R_2$ is longer than the length l of one pattern-bearing section cut from the tape, but shorter than the length l plus the width a of a mark. More specifically, the detector spacing rather approximates to the length l plus the width a, that is, the distance between the outer sides of two successive marks so that the detectors are very sensitive to deviation of marks from the position of the detectors.

Overfeed of tape

Figure 4B:
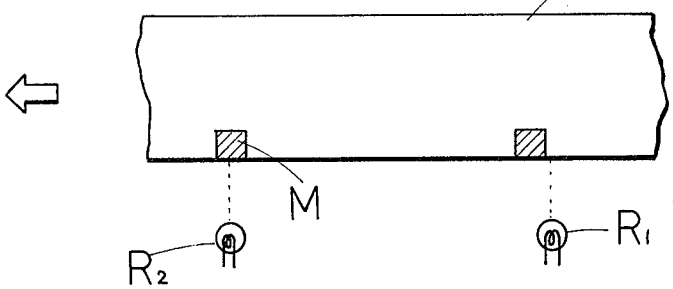

If the tape T is fed by means of the larger drum 2 having a circumferences lightly longer than the length of a label, the rate of feed is slightly higher. The tape is slightly overfed. Eventually, the following one of the two successive marks goes beyond the position of the upstream detector $R_1$ at the time of actuation of the photoelectric detectors as shown in FIG. 4*b*.

The turning-on of the detector $R_1$ breaks the corresponding contact $R_1$ in the circuit shown in FIG. 5. Then the electromagnetic clutch $C_2$ associated with the larger drum 2 is deenergized to disengage the disc 23 from the drum 2, thereby making the larger drum 2 independent of its drive shaft 21.

At this point, the larger drum 2 reduces its circumferential speed to that of the smaller drum 3 which is now rotated at a constant revolution by means of its drive shaft 31. The rate of feed of the tape is reduced to the circumferential speed of the smaller drum 3. As a result, at the time of the next actuation, beams emitted by the detectors $R_1$ and $R_2$ are both absorbed by the next two successive black marks as shown in FIG. 4*a*. Neither the upstream detector $R_1$ nor the downstream detector $R_2$ is turned on.

Underfeed of tape

The smaller drum 3 continues to feed the tape.

Figure 4C:
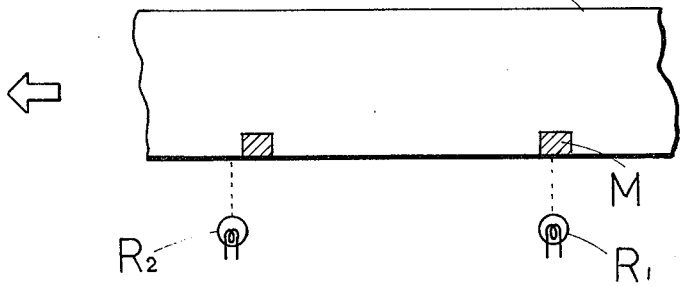

The tape is fed at a slightly lower rate. When the delay of tape feed exceeds an allowable range (which depends on the degree of approximation of the distance between the upstream and the downstream detectors $R_1$ and $R_2$ to the distance (l+a) between the outer sides of two successive marks), the preceding one of the two successive marks goes behind the position of the downstream detector $R_2$ as shown in FIG. 4*c*. Then the downstream detector $R_2$ detects the absence of a black mark and is turned on.

The turning-on of the detector $R_2$ makes the corresponding contact $R_2$ in the circuit shown in FIG. 5. Then the electromagnetic clutch $C_2$ associated with the larger drum 2 is energized to engage the disc 23 with the drum 2, thereby allowing the drive shaft 21 to drive the drum 2. The larger drum 2 rotates at a higher circumferential speed than the smaller drum 3, but the smaller drum 3 is allowed to rotate at a higher revolution than that of its drive shaft 31 by virture of the unidirectional clutch $C_3$. The rate of feed of the tape is increased to the circumferential speed of the larger drum 2.

As a result, at the time of the next actuation, beams emitted by the detectors $R_1$ and $R_2$ are both absorbed by the next two successive black marks as shown in FIG. 4*a*. Neither the upstream detector $R_1$ nor the downstream detector $R_2$ is turned on. The closing of the contact $R_2$ and the actuation of the electromagnetic clutch $C_2$ are sustained.

Function of Electromagnetic Brake $C_4$

Immediately after tape transportation is changed from the faster mode of feed controlled by the larger drum 2 to the slower mode of feed controlled by the smaller drum 3, the smaller drum 3, which is associated with the drive shaft 31 via the unidirectional clutch $C_3$, will continue to rotate at a higher speed than the associated drive shaft 31 due to inertia. This inertial rotation continues only for a very short time, but prevents the tape feeding speed from being corrected immediately after the driving drum is changed.

The electromagnetic brake $C_4$ is provided to eliminate such a delay of feed speed correction. The output signal of the upstream detector $R_1$ is supplied not only to the electromagnetic clutch $C_2$ to disengage the disc 23 from the drum 2, but also to the electromagnetic brake $C_4$. Upon receipt of the signal, the electromagnetic brake $C_4$ is energized to urge the movable disc 36 in contact with the frictional pad 39 on the smaller drum 3, thereby keeping the smaller drum 3 and the drive shaft 31 in the relatively restrained relationship. As a result, the smaller drum 3 is prevented from rotating at a higher speed than the drive shaft 31 and the change of tape feeding speed comes into effect immediately.

Once the cooperation between the smaller drum 3 and the drive shaft 31 is achieved, then the unidirectional clutch $C_3$ functions to interlock them. Accordingly, the energization of the electromagnetic brake $C_4$ or the frictional contact between the disc 36 and the pad 39 may be cancelled to render the smaller drum 3 free of the drive shaft 31 either immediately after the relative restrained relationship is achieved between the smaller drum 3 and the drive shaft 31 or at the same time as an output signal of the downstream detector $R_2$ is supplied to the electromagnetic clutch $C_2$ to bring the larger drum 2 in engagement with the drive shaft 21.

Another embodiment which can attain the objects of the present invention is illustrated in FIG. 7. In this embodiment, the larger and smaller drums 2 and 3 are provided with electromagnetic clutches $C_2$ and $C_2$ of the same construction. These clutches may be the same as illustrated in FIG. 2. The Electromagnetic clutches and the photodetectors are electrically connected such that the clutches are alternatively energized upon receipt of an output signal of either detector.

It may be understood that the electromagnetic brake $C_4$ may be omitted in the first embodiment in the event of low speed operation.

As described above, according to the present invention, the larger drum 2 having a longer circumference and a higher coefficient of friction is mounted on the drive shaft 21 via the electromagnetic clutch $C_2$ whereas the smaller drum 3 having a shorter circumference is mounted on the drive shaft 31 via the unidirectional clutch $C_3$ and the electromagnetic brake $C_4$ adapted to bring the smaller drum in engagement with the drive shaft.

With the electromagnetic clutch $C_2$ disconnected, the larger drum 2 is independent of its drive shaft 21 and rotates with the smaller drum 3 which is rotated by means of its drive shaft 31 rotating at a constant revolution. The tape T is fed at a lower rate equal to the circumferential speed of the smaller drum 3.

On the contrary, when the electromagnetic clutch $C_2$ is actuated to interlock the larger drum 2 with the disc 23, the larger drum 2 is rotated by its drive shaft 21. The smaller drum 3 is mounted on the shaft 31 via the unidirectional clutch $C_3$ which allows the smaller drum 3 to be forcedly rotated with the larger drum 2. As a result, the tape T is fed at a higher rate equal to the circumferential speed of the larger drum 2.

The smaller drum 3 is brought into engagement with the drive shaft 31 immediately after the tape feeding speed is changed from the faster mode of feed by the larger drum 2 to the slower mode of feed by the smaller drum 3.

Irrespective of accumulation of indefinite factors causing variations in length of individual pattern-bearing sections, for example, accumulation of expansion and/or positioning errors of patterns on the tape during printing, expansion of the tape due to the pulling force during tape pulling, and the like, the tape can be fed accurately one by one pattern to the subsequent station operating at a constant rate, for example, a cutter or a duplex printing machine.

Furthermore, after the tape feeding speed is changed into the slower mode of feed by the smaller drum, the inertial rotation of the smaller drum at a higher speed is immediately interrupted, and the smaller drum rotates integrally with the drive shaft at the same speed. Feeding speed correction is instantaneously started without allowing the smaller drum to continue its higher speed rotation even for a very short time.

What is claimed is:

1. In a tape feeding apparatus comprising a pair of first and second cylindrical drums rotatable in tangential contact so as to pull a tape out of its roll by frictionally driving the tape therebetween, wherein said tape has a series of the same patterns and check marks printed thereon and is to be divided into sections which are intended to be of a certain predetermined design length, each bearing one printed pattern, the improvement comprising the first drum mounted for free rotation on a first drive shaft and having a circumference slightly longer than the predetermined length of one section of the tape, the second drum mounted for free rotation on a second drive shaft and having a circumference slightly shorter than said predetermined length of one section, an electromagnetic clutch provided between said first drum and said first drive shaft, a unidirectional clutch provided between said second drum and said second drive shaft, an electromagnetic brake provided between said second drum and said second drive shaft and operable to keep the second drum and the second drive shaft in a relative restrained relationship, and photoelectric means for detecting two successive check marks on the tape and including an output electrically connected to said electromagnetic clutch and brake, wherein said electromagnetic clutch is brought into and out of transmission engagement upon receipt of an output signal from said photoelectric detecting means, and said electromagnetic brake is operable to bring the second drum in engagement with the second drive shaft at the same time as said electromagnetic clutch is de-energized.

2. An apparatus according to claim 1 wherein said electromagnetic clutch includes a disc mounted for axial motion on the first drive shaft, restrained of relative rotation to the first shaft and having one surface facing the first drum end and an electromagnet disposed on one side of the disc remote from the first drum, wherein energization of the electromagnet causes said one surface of the disc to be in frictional contact with the drum to provide transmission between the first drive shaft and the first drum.

3. An apparatus according to claim 2 wherein said unidirectional clutch is constructed such that it normally provides transmission between the second drive shaft and the second drum, and allows the second drum to be rotated at a higher revolution than the second drive shaft.

4. An apparatus according to claim 3 wherein said photoelectric means includes an upstream and a downstream photoelectric detector arranged along the tape path and spaced apart a distance which is longer than the predetermined length of one section, but shorter than the predetermined length of one section plus the length of one mark so that both the detectors normally detect the presence of corresponding two successive marks on the tape, whereby the upstream detector detects the absence of a corresponding mark to generate a signal to de-energize the electromagnet, whereas the downstream detector detects the absence of a corresponding mark to generate another signal to energize the electromagnet.

5. An apparatus according to claim 1 wherein said electromagnetic brake includes a disc mounted for axial motion on the second drive shaft, restrained of relative rotation to the second shaft and having one surface facing the second drum end, and an electromagnet disposed on one side of said disc remote from the second drum, wherein energization of the electromagnet causes said one surface of the disc to be in frictional contact with the drum to provide transmission between the second drive shaft and the second drum.

6. In a tape feeding apparatus comprising a pair of first and second cylindrical drums rotatable in tangential contact so as to pull a tape out of its roll by frictionally driving the tape therebetween, wherein said tape has a series of the same patterns and check marks printed thereon and is to be divided into sections which are intended to be of a certain predetermined design length, each bearing one printed pattern, the improvement comprising the first drum mounted for free rotation on a first drive shaft and having a circumference slightly longer than the predetermined length of one section of the tape, the second drum mounted for free rotation on a second drive shaft and having a circumference slightly shorter than said predetermined length of one section, first means provided between said first drum and said first drive shaft for selectively interlocking the first drum with the first drive shaft, second means provided between said second drum and said second drive shaft for selectively interlocking the second drum with the second drive shaft, and means operatively connected to said first and second interlocking means for alternatively actuating the first and second interlocking means and associated with the continuously advancing tape for detecting whether the tape is fed for every one section with an increment or decrement, wherein said detecting means functions to release the first interlocking means and actuate the second interlocking means when it detects that the tape is fed for one section with an increment, but to actuate the first interlocking means and release the second interlocking means when it detects that the tape is fed for one section with a decrement.

7. An apparatus according to claim 6 wherein said first and second interlocking means are electromagnetic clutches.

8. An apparatus according to claim 7 wherein each said electromagnetic clutch includes a disc mounted for axial motion on the drive shaft, restrained of relative rotation to the drive shaft, and having one surface facing the end of the drum, and an electromagnet secured to a support on one side of the disc which is remote from the drum, wherein energization of the electromagnet causes one surface of the disc to be in frictional contact with the drum to provide transmission between the drive shaft and the drum.

* * * * *